United States Patent [19]

McIntosh et al.

[11] 4,090,163

[45] May 16, 1978

[54] ELONGATED SNAP-ACTING BIMETAL ELEMENT

[75] Inventors: Harold A. McIntosh; Hollis L. Randolph; Bradford N. Hull, all of Los Angeles, Calif.

[73] Assignee: Robertshaw Controls Company, Richmond, Va.

[21] Appl. No.: 638,135

[22] Filed: Dec. 5, 1975

Related U.S. Application Data

[62] Division of Ser. No. 495,167, Aug. 6, 1974, Pat. No. 3,976,966.

[51] Int. Cl.[2] ..... H01H 61/00

[52] U.S. Cl. ..... 337/102; 337/111; 337/365; 337/379; 337/89

[58] Field of Search ..... 337/89, 111, 343, 365, 337/379, 104, 347, 102, 88, 390, 391; 339/276 T

[56] References Cited

U.S. PATENT DOCUMENTS

| | | | |
|---|---|---|---|
| 2,041,775 | 5/1936 | Mottlau | 73/362.6 |
| 2,266,537 | 12/1941 | Elmer | 337/391 |
| 2,574,869 | 11/1951 | Green | 337/88 |
| 3,004,203 | 10/1961 | Epstein | 318/221 |

*Primary Examiner*—Robert J. Hickey
*Attorney, Agent, or Firm*—O'Brien & Marks

[57] ABSTRACT

An elongated bimetal member has a transverse curvature opposing temperature warp and a longitudinal curvature aiding temperature warp. The transverse curvature maintains the member straight in a longitudinal direction until the sum of the longitudinal temperature warp forces and the bias of the longitudinal curvature exceed the retaining forces of the transverse curvature.

3 Claims, 13 Drawing Figures

FIG 1
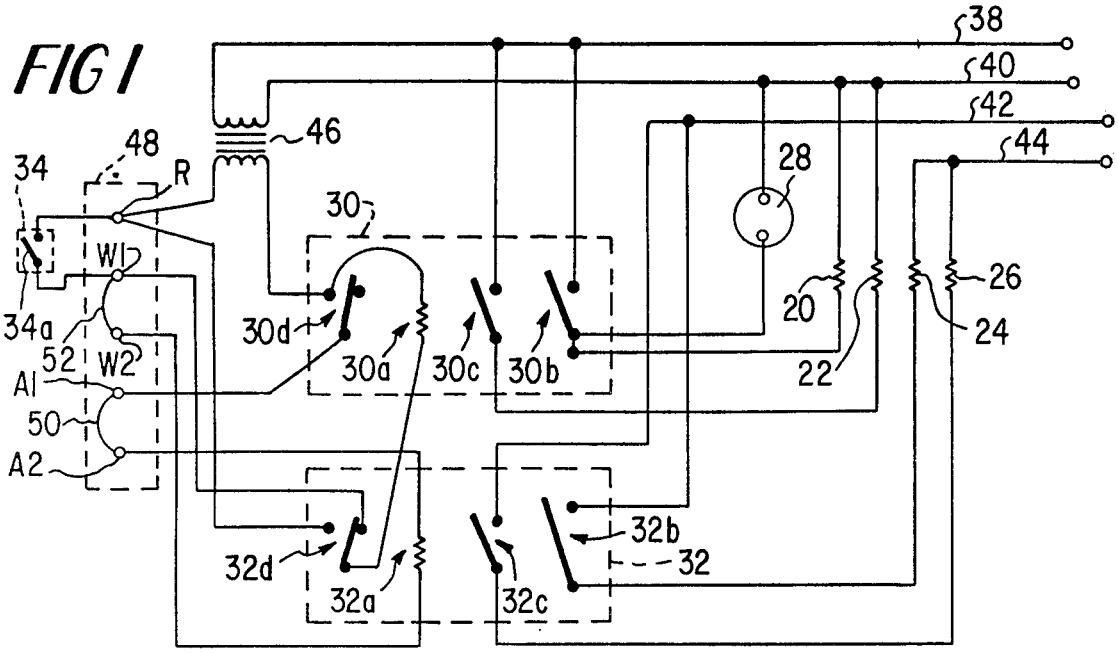
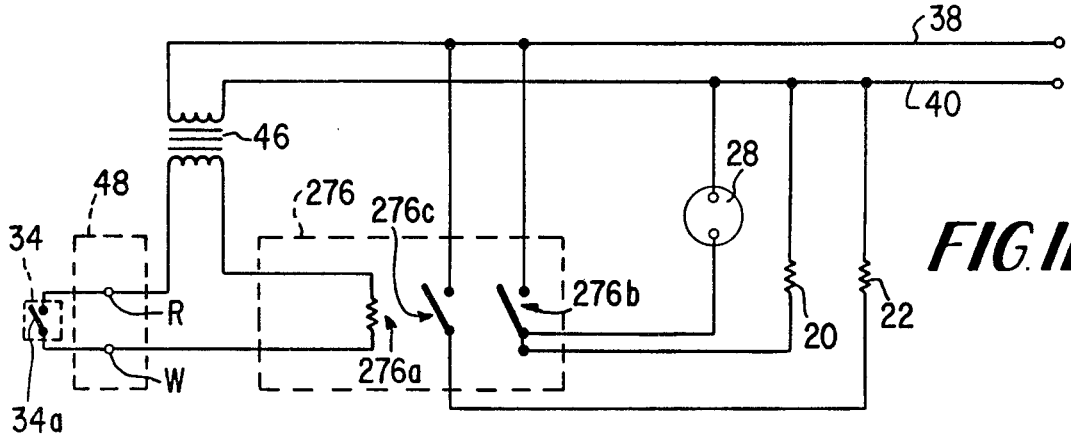
FIG. 11
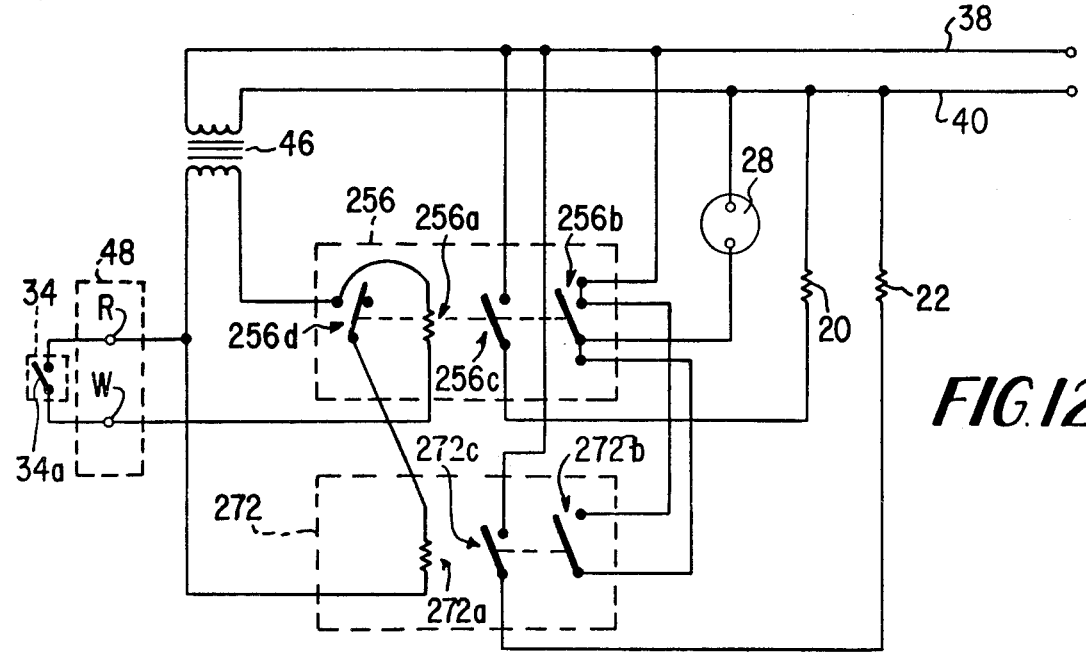
FIG. 12

ELONGATED SNAP-ACTING BIMETAL ELEMENT

CROSS REFERENCE TO RELATED APPLICATION

This application is a division of Ser. No. 495,167, filed Aug. 6, 1974, now U.S. Pat. No. 3,976,966.

BACKGROUND OF THE INVENTION

1. Field of the Invention

The invention relates to bimetal elements such as those used in electric sequencing relays for heating systems.

2. Description of the Prior Art

The prior art, as exemplified by U.S. Pat. Nos. 2,041,775, 2,266,537, 2,498,127, 2,574,869, 3,257,526, 3,405,380, 3,546,651, 3,634,801 3,688,060 and 3,713,062 contains a number of thermally operated relay devices. Some of the prior art devices employ snap acting elongated bimetal members heated by internal current and upon which contacts are mounted; other devices employ elongated non-snap-acting bimetal elements having a free end engaging an elongated member slidable in housing for operating a switch, such as a snap-acting switch; still other prior art devices employ a plurality of snap-acting discs heated by separate heaters and which engage slidable motion transfer pins engaging flexible contact arms. Heating of bimetal elements, either by internal resistance heating or by heating coils wound on the bimetal elements in thermo-relays results in repeated flexing of leads and/or coils causing failure of such leads and/or coils. Snap acting switches usually employ separate spring devices, or the like, for producing a snap action in closing the switches resulting in higher cost for thermo relays containing such thermo relays. Snap acting discs are generally formed with considerable die force producing appreciable metal flow to provide the disc shape required for snap action, resulting in increased costs and/or less uniformity in the temperature response of the discs. Also, prior art thermo relays using a sliding member in a housing wherein the member is moved in one direction by a resilient contact arm can result in significant reduction of contact force due to friction forces or gravity forces on the sliding member.

The prior art also contains a number of heating systems employing thermally operated relays to sequentially energize heating elements, as exemplified in U.S. Pat. Nos. 3,046,380, 3,242,978, 3,329,869, 3,351,739, 3,588,471, 3,659,155 and 3,770,977. Generally, air blowers in such heating systems must be maintained in operation when any of the heating elements is energized to prevent burn out or failure of the heating elements. Some of the prior art systems utilize a lower temperature operated thermo-switch device than that employed to energize heating elements, and others employ heater element current sensing facilities for maintaining air blower operation.

SUMMARY OF THE INVENTION

The invention is summarized in that an elongated snap-acting bimetal element having a single stable state at a predetermined temperature comprises a first strip-like layer of metal having a first coefficient of thermal expansion, a second strip-like layer of metal bonded on the first layer and having a second coefficient of thermal expansion, the second coefficient of thermal expansion being substantially different from the first coefficient of thermal expansion, the first and second bonded layers adapted to be secured at one end with the other end extending free, the first and second bonded layers being bent into a transvere radius of curvature at about the predetermined temperature to retain the bonded first and second layers against longitudinal curvature until a temperature is reached whereat longitudinal curvature forces exceed the retaining forces of the transverse curvature producing snap longitudinal curvature changes, the first and second bonded layers also being bent into a longitudinal radius of curvature at about the predetermined temperature, the transverse radius of curvature being selected to oppose the force of temperature warp by increasing temperatures, and the longitudinal radius of curvature being selected to add to the force of temperature warp by increasing temperature.

An object of the invention is to construct a snap-acting elongated bimetal element with a single state at normal temperatures and which is less expensive and more reliable than prior art electrothermal relays.

An additional feature of the invention includes the provision of a tapered free end on an elongated bimetal element eliminating the necessity for heating such free end.

BRIEF DESCRIPTION OF THE DRAWINGS

FIG. 1 is a diagram of an electrical circuit portion of an electric heating system in accordance with the invention.

FIG. 11 is a diagram of a variation of the heating system circuit shown in FIG. 1.

FIG. 12 is a diagram of still another variation of the heating system circuit shown in FIG. 1.

DESCRIPTION OF THE PREFERRED EMBODIMENTS

Figure 3:
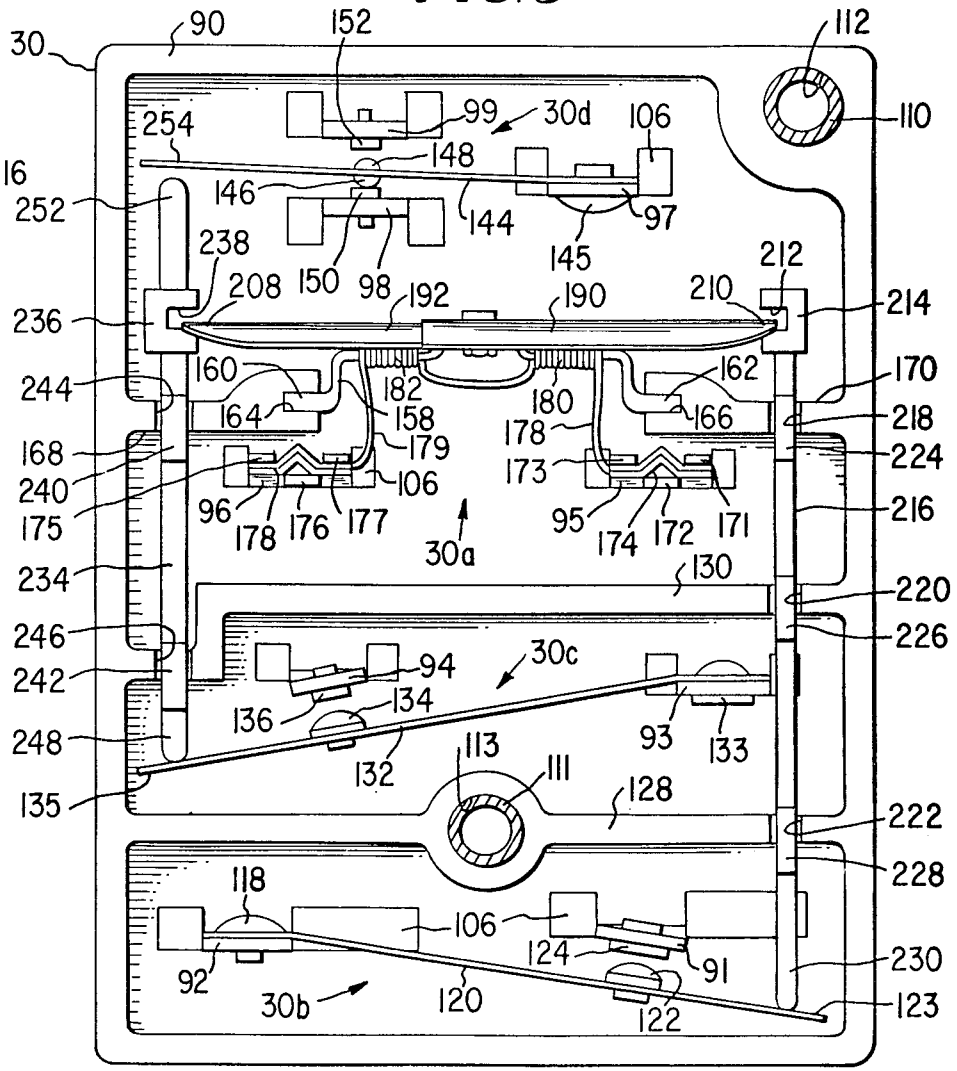
FIG. 3 is a back view of the sequencer of FIG. 2 with the back cover plate removed.

As is illustrated in FIG. 1, the invention is embodied in an electrical circuit for an electric heating system including electrical heating elements 20, 22, 24 and 26 and a blower motor 28 operated by relays 30 and 32 controlled by a thermostat switch device 34 for sequentially energizing and deenergizing the elements 20, 22, 24 and 26 while maintaining the blower motor 28 operating when any of the elements 20, 22, 24 and 26 is energized. The electrical heating elements 20, 22, 24 and 26 are conventional resistance heating elements mounted in a suitable heat exchange chamber (not shown) through which a fluid flow, such as air, is controlled by a fluid flow device, such as an air blower (not shown) driven by the motor 28, to provide for heat transfer to a room where the thermostat 34 is positioned. Since constructions of suitable heat exchange chambers, air blowers, and ducts are well known and are described in the prior art, they are not described in detail herein.

The sequencer 30 includes a heat motor indicated generally at 30*a*, normally open power switches indicated generally at 30*b* and 30*c* and a single-pole double-throw low voltage control switch indicated generally at 30*d*. Similarly the sequencer 32 includes a heat motor indicated generally at 32*a*, normally open power switches indicated generally at 32*b* and 32*c* and a single-pole double-throw low voltage control switch indicated generally at 32*d*. The thermostat switch device 34 is a conventional thermostat which has contacts 34*a* which close at temperatures below a selected temperature and open at temperatures above the selected temperature.

In the power circuit for energizing the heating elements 20, 22, 24 and 26, one side of the normally open switch 30*b* is connected to a power line 38 while the electric heating element 20 and the blower motor 28 are connected in parallel between the other side of the switch 30*b* and a power line 40. One side of the switch 30*c* is connected to the power line 38 while the heating element 22 is connected between the other side of the switch 30*c* and the power line 40. One side of the switch 32*b* is connected to a power line 42 while the heating element 24 is connected between the other side of the switch 32*b* and a power line 44. Similar, one side of the switch 32*c* is connected to the power line 42 while the resistance element 26 is connected between the other side of the switch 32*c* and the power line 44. The power lines 38 and 40 are connected across a suitable power source, such as a 120 or 240 volt 60 hertz alternating current source, while the power lines 42 and 44 are also connected across the same or a similar power source.

A low voltage control circuit includes a step-down voltage transformer, such as a 240 volt to 24 volt transformer 46, having its primary winding connected across the power lines 38 and 40 with its secondary winding in a series circuit through the heat motor 30*a*, the contact arm of the switch 32*d*, the normally closed contact of the switch 32*d*, a terminal W1 of a low voltage terminal block 48, the contacts 34*a* of the thermostat device 34 and terminal R of the low voltage terminal block 48. Another circuit across the secondary of transformer 46 includes the normally open contact of switch 30*d*, the contact arm of the switch 30*d*, a terminal A1 of the low voltage terminal block 48, a jumper wire 50, a terminal A2 of the low voltage terminal block 48, the heat motor 32*a*, a terminal W2 of the terminal block 48, a jumper wire 52, the terminal W1, and the thermostat contacts 34*a* to the terminal R when the switch 30*d* is operated. The normally open contact of the switch 32*d* is connected to the terminal R of the low voltage terminal block 48 to form a circuit through the heat motor 30*a*, the contact arm of the switch 32*d*, and the normally open contact of the switch 32*d* to the terminal R when the switch 32*d* is operated.

Figure 2:
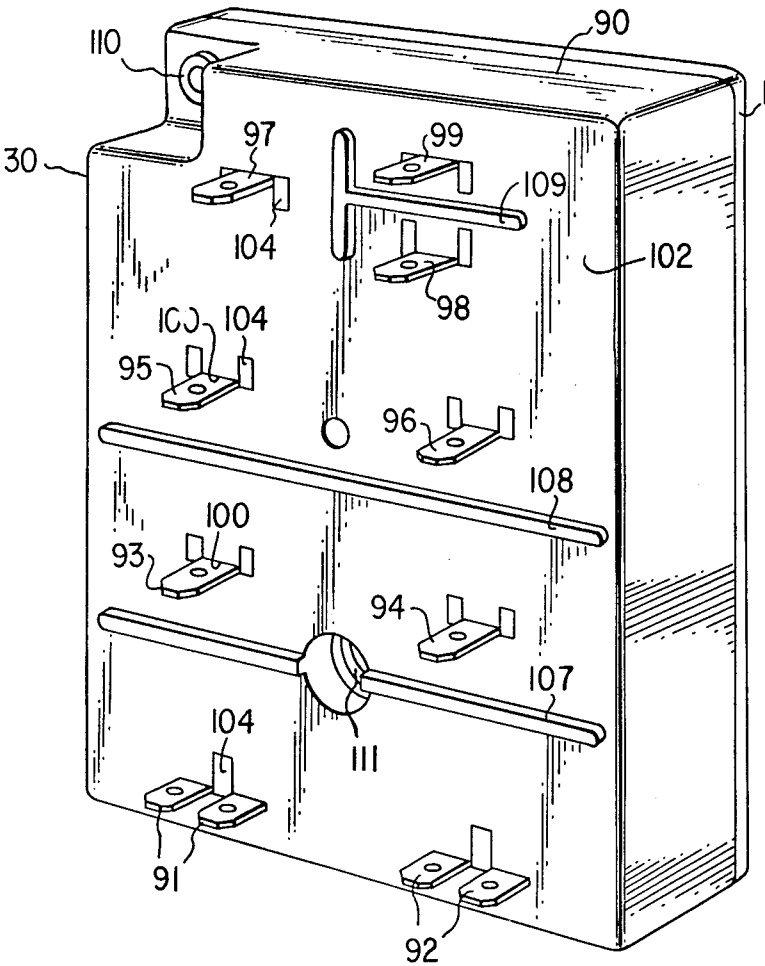
FIG. 2 is a prospective view of a thermal sequencing relay or sequencer for use in the heating system of FIG. 1.

As illustrated in FIGS. 2 and 3, the sequencer 30, which is substantially similar to the sequencer 32, includes a housing 90 made of a suitable insulative material, such as a phenolic resin, and having electrically conductive terminals 91, 92, 93, 94, 95, 96, 97, 98 and 99 extending through slots 100 in a front wall 102 of the housing 90. The terminals 91 through 99 are formed from metal strips and have portions projecting outward from the housing 90 forming quick connect and disconnect terminals for securing suitable connectors and leads thereto for making the electrical circuit connections shown in FIG. 1 to the sequencer 30; the terminals 91 and 92 each having a pair of outward projecting portions for securing a pair of connectors thereto. Tab portions 104 of the terminals 90 through 99 are bent into engagement and recessed in the outside surface of the front wall 102 while tab portions 106 of the terminals 91 through 99 are bent into engagement with the inside or interior surface of the front wall 102 for firmly securing the terminals 91 through 99 in the slots 100 through the front wall 102 of the housing 90. Ribs 107, 108 and 109 are provided on the exterior surface of the wall 102 to increase electrical isolations of the terminals 91 through 99. Tubular rivets or eyelets 110 and 111 extend through holes 112 and 113 in recessed portions of the front wall 102 and through holes (not shown) in a back cover 116 for securing the back cover 116 to the housing 90. The eyelets 110 and 111 have a suitable size for receiving screws or bolts (not shown) to mount the housing 90 on a suitable support (not shown).

Inside of the housing 90, as shown in FIG. 3, a rivet 118 secures one end of a resilient flexible contact arm 120 on the terminal 92. A movable contact 122 is mounted on the arm 120 intermediate the secured end and a free end 123 of the arm 120. The movable contact 122 is aligned for engaging a stationary contact 124 which is mounted on the terminal 91. The power switch 30*b*, which includes the contact arm 120 and contacts 122 and 124, is isolated within a chamber formed by a partition or wall 128 within the housing 90. Similarly the power switch 30*c*, isolated in a chamber formed by a wall or partition 130, includes a resilient contact arm 132 mounted by a rivet 133 on the terminal 93, a movable contact 134 attached to the arm 132 intermediate its secured end and a free end 135, and a stationary contact 136 mounted on the terminal 94 in alignment to be engaged by the movable contact 134. The control switch 30*d* includes a resilient contact arm 144 mounted by a rivet 145 on the terminal 97, movable contacts 146 and 148 mounted on opposite sides of the contact arm 144, and stationary contacts 150 and 152 mounted on the respective terminals 98 and 99 in alignment with the respective movable contacts 146 and 148. The arms 120, 132 and 144 are formed of suitable relatively conductive and resilient metals, such as beryllium copper, and are mounted on the terminals 92, 93 and 97 such as to urge the movable contacts 122, 134 and 146 into engagement with the respective stationary contacts 124, 136 and 150; the arm 144 urging the movable contact 148 away from the stationary contact 152.

The heat motor 30*a* includes an inverted U-shaped member 158 having outwardly flared ends 160 and 162 supportingly engaged within slots 164 and 166 formed in respective projecting portions 168 and 170 of the housing 90. The inside end of the terminal 95 is split into three projecting prongs 171, 172 and 173 between which are wedged a connector 174. Similarly, the inside end of the terminal 96 is split into three projecting prongs 175, 176 and 177 between which are wedged a connector 178. The connectors 174 and 178 are conductive metal strips which are folded over insulation-stripped portions of ends 178 and 179 of a resistance wire wound into equal divided coil portions 180 and 182 on opposite sections of the member 158. The folded connectors 174 and 178 are clinched into a W-configuration prior to being forced between the prongs to insure a good electrical connection to the heat wire ends 178 and 179.

Figure 4:
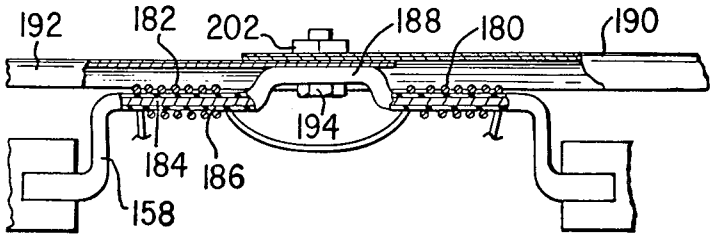
FIG. 4 is a detailed view partially in cross section of a broken away portion of the sequencer as shown in FIG. 3.

As shown in FIG. 4, the member 158 is formed from a thermally conductive strip 184 which is coated, at least on the surfaces where the coil portions 180 and 182 are mounted, with a thin electrically insulative film 186. A suitable material for the metal strip 184 can be selected from heat resistant metals, such as the stainless steels, while the film 186 can be formed by dip-coating or wrapping a film of insulative material such as polyimide plastic sold under the trademark KAPTON by DuPont, E. I. de Nemours & Co., Inc., on the strip 184. A film 186 having a thickness in the range from 0.0254 to 0.0508 millimeters (1 to 2 mils) provides suitable electrical insulation while permitting thermal conductivity through the film 186. The resistance wire forming coil portions 180 and 182 is a suitable insulated resistance wire, such as a glass fiber covered wire, which has a suitable resistance to form an electrical heater with a positive temperature coefficient of resistance. One suitable insulated resistance wire is a nickel alloy BALCO sold by Wilbur B. Driver Co., of Newark, New Jersey. An upward extending boss 188 is formed in the member 158 and has one end of elongated and strip-like bimetal members or elements 190 and 192 secured thereto, such as by a rivet, or a bolt 194 extending through aligned openings in the boss 188 and the bimetal elements 190 and 192 and secured by a nut 202. The boss 188 is suitably formed to support the bimetal elements 190 and 192 in a spaced relationship above the portions 180 and 182 of the heater coil.

Figure 5:
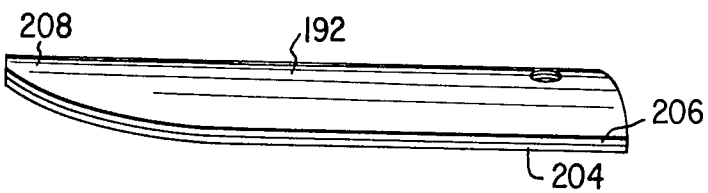
FIG. 5 is a detailed view of a bimetal element in a low temperature state of the sequencer of FIGS. 2 and 3.
Figure 6:
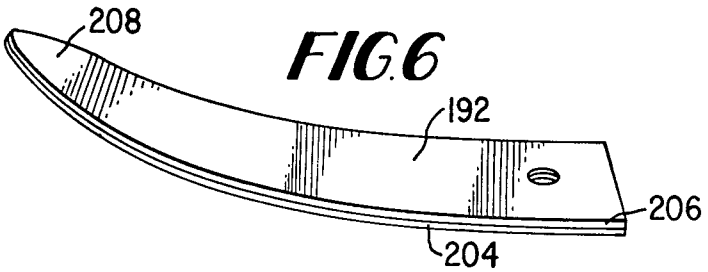
FIG. 6 is a view similar to FIG. 5, but illustrating a high temperature state of the bimetal element.

Referring to FIGS. 5 and 6, the bimetal element 192 includes a layer 204 of a metal with a relatively large positive coefficient of thermal expansion bonded to a layer 206 of a metal with a substantially lesser coefficient of the thermal expansion. The grain directions of the bimetal element 192 generally run along the longitudinal direction of the element 192. The bimetal element 192 is formed or bent, at about room temperature, into a longitudinal radius of curvature as shown in FIG. 6. Then the bimetal element 192 is formed or bent into a transverse radius of curvature as shown in FIG. 5 substantially less than the longitudinal radius of curvature of FIG. 6 to normally hold the bimetal element 192 longitudinally straight at temperatures less than a predetermined temperature which is substantially above the normal room temperature of formation. The transverse curvature of the bimetal element 192 is selected in consideration with the relative coefficients of thermo expansion of the layers 204 and 206 to resist longitudinal curvature or temperature warp until the predetermined temperature is reached where the transverse warp reduces the degree of transverse curvature or flattens the bimetal element 192 until the sum of the forces generated by the longitudinal temperature warp and the stress resulting from the longitudinal curvature in formation of the element 192 exceed the retaining forces of the transverse curvature for producing an upward snap action movement of a free end 208 of the bimetal element 192. The metals of the layers 204 and 206 are further selected to be essentially resilient throughout their ranges of curvature produced by temperature changes to allow the element 192 to snap back to its position in FIG. 5 when the temperature is reduced to a temperature which is slightly less than the predetermined temperature and when the stress from the formed transverse curvature exceeds the sum of the temperature warp forces and the stress of the formed longitudinal curvature. The corners of the free end 208 of the bimetal element 190 are removed to form a tapered end.

The bimetal element 190 is similar to the bimetal element 192 except that the bimetal element 190 is selected to operate at a lower temperature than the bimetal element 192. Since temperature of operation is determined by the degree of transverse curvature when the other relative parameters are about equal in the elements 190 and 192, making the bimetal element 190 with a larger transverse radius of curvature, i.e., more flat, than the element 192 results in the element 190 snapping to its raised or longitudinally curved position and returning to its longitudinally straight position at significantly lower operating temperatures than the respective operating temperatures of the element 192. The bimetal element 190 is mounted on top so that its inside curved surface is next to the outside transverse curved surface of the bimetal element 192.

The tip or free end 210 of the bimetal element 190 extends into a transverse slot 212, FIG. 3, formed within an enlarged portion 214 of an elongated switch operator 216 which slidably extends through slots 218, 220 and 222 formed within the respective portion 170, partition 130 and partition 128 to be moved therein by the movement of the end 210. The operator 216 is formed of a rigid insulative material such as a phenolic resin and has portions 224, 226 and 228 which have rectangular transverse cross sections mating with the slots 218, 220 and 222 such as to prevent rotation of the operator 216 about a longitudinal axis. The operator 216 has a length designed to engage an end 230 of the operator against the free or unsecured end 123 of the switch arm to normally force the switch arm 120 to a position disengaging the movable contact 122 from the stationary contact 124 when the bimetal element 192 is in its low temperature state or is longitudinally straight, and to disengage the end 230 from the end 123, FIG. 7, when the bimetal element 190 is in its high temperature or longitudinally curved state.

An elongated switch operator 234 has an enlarged portion 236 with a slot 238 for receiving the tip or free end 208 of the bimetal element 192. The operator 234, formed of a material similar to the operator 216, has portions 240 and 242 with rectangular transverse cross sections slidably extending within slots 244 and 246 formed in the respective portion 168 and the partition 130 for slidably supporting the operator 234 while preventing rotation of the operator 234. The lower end 248 of the operator 234 extends such as to engage the free end 135 of the switch arm 132 to normally disengage the movable contact 134 from the stationary contact 136 when the bimetal element 192 is longitudinally straight or in its low temperature state, and to disengage the end 248 from the end 135, FIG. 8, when the bimetal element 192 is in its high temperature state. The upper end 252 of the operator 234 is disposed beneath a free end 254 of the switch arm 144 to allow the resilient arm 144 to normally bias the movable contact 146 into engagement with the normally closed contact 150. The operator 234 has a length extending to its end 252 designed to engage the end 254 of the contact arm 144 and move the contact 146 from engagement with the contact 150 and to move the movable contact 148 into engagement with the stationary contact 152 when the bimetal element 192 changes to its high temperature state where it is longitudinally curved.

The various parameters of the heating coil portions 180 and 182 and the bimetal elements 190 and 192 are selected to produce suitably delay operating and return times for the bimetal elements 190 and 192 when the heating coil is energized and deenergized. For example, such parameters can be selected to change the bimetal element 190 to its high temperature state about 25 seconds after energization of the heating coil portions 180 and 182, and to return the bimetal element 190 to its low temperature state about 60 seconds after deenergization of the heating coil portions 180 and 182; and such parameters can be selected to snap the bimetal element 192 to its high temperature state about 45 seconds after energization of the heating coil portions 180 and 182, and to return the bimetal element 192 to its low temperature state about 40 seconds after deenergization of the heating coil portions 180 and 182.

In operation of the electric heating system circuit shown in FIG. 1, the thermostat 34 operates the sequencers 30 and 32 to sequentially energize the heating elements 20, 22, 24 and 26 and to sequentially deenergize the heating elements 26, 24, 22 and 20 maintaining the blower motor 28 energized while any of the heating elements 20, 22, 24 and 26 is energized.

More particularly, a decrease in room temperature below the selected temperature of the thermostatic switch device 34 closes contacts **34*a* connecting the terminal R to terminal W1 energizing the heat motor 30*a* of the sequencer 30. After a first delay, switch 30*b* closes applying electric power to the heating element 20 and to the blower motor 28. After a second delay, the switch 30*c* of the sequencer 30 closes energizing the heating element 22, and the switch 30*d* operates energizing the heat motor 32*a*. The sequencer 32 delays closing the switch 32*b* energizing the heating element 24, and then after a further delay closes the switch 32*c* energizing the heating element 26. Thus, the heating elements 20, 22, 24 and 26 are sequentially connected to the power source thus avoiding excessive voltage and current surges produced in the power lines 38, 40, 42 and 44 which would occur if all of the heating elements 20, 22, 24 and 26** were energized at the same time.

Simultaneously with the closing of the switch **32*c*, the single-pole double-throw switch 32*d* operates disconnecting the heat motor 30*a* and the contact arm of the switch 32*d* from the normally closed contact of the switch 32*d* and the circuit through the thermostat contacts 34*a*, and connecting the contact arm of the switch 34*d* to the normally open contact of the switch 34*d* to bypass the thermostatic contacts 34*a*. When the room temperature again reaches the selected temperature of the thermostat 34, the contacts 34*a* open deenergizing the heat motor 32*a* which, after a delay, opens the switch 32*c* deenergizing the heater element 26, and returns the contact arm of the switch 32*d* from the normally open contact to the normally closed contact to deenergize the heat motor 30*a*. Then the switches 32*b* and 30*c* sequentially deenergize the heating elements 24 and 22. Lastly, the switch 30*b* opens simultaneously deenergizing the heating element 20 and the blower motor 28. The switch 30*d* disconnects its contact arm from its normally open contact to disconnect the heat motor 32*a* from the thermostat switch 34*b* preventing operation of the sequencer 32 by a subsequent closing of contacts 34*a* until after the sequencer 30** operates.

Figure 7:
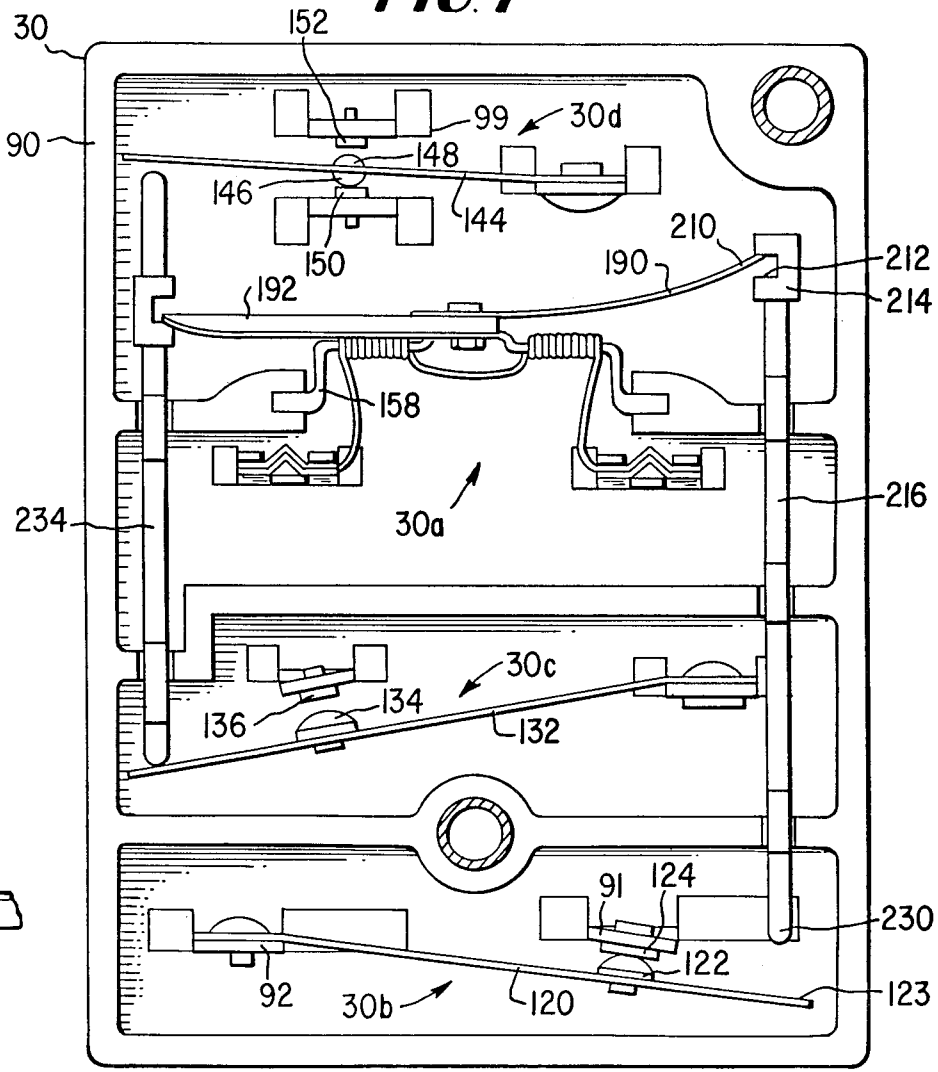
FIG. 7 is a view similar to FIG. 3 but illustrating a first bimetal element in a high temperature state.
Figure 8:
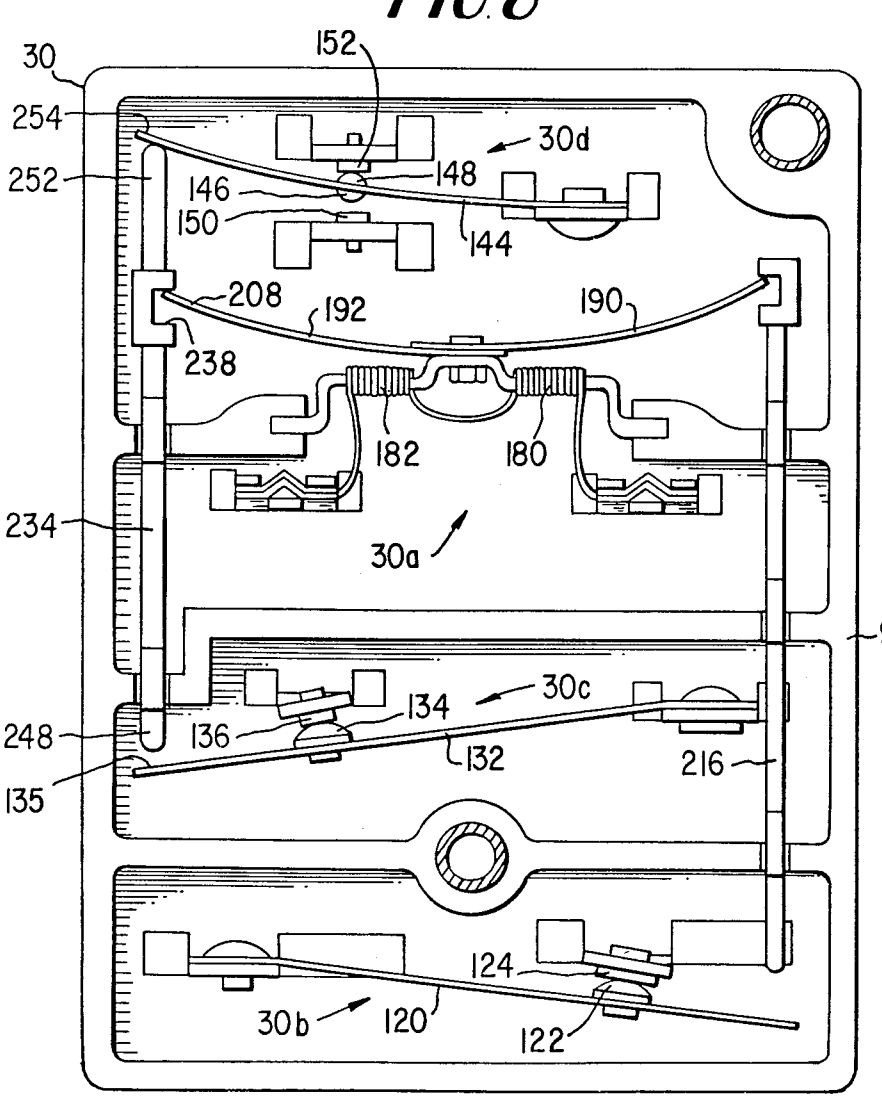
FIG. 8 is a view similar to FIGS. 3 and 7 but illustrating first and second bimetal elements in high temperature states.

Referring to FIGS. 2 and 3 when the heat motor **30*a* is energized by applying voltage across terminals 95 and 96, heat from the heater coil portions 180 and 182 begins raising the temperature of the bimetal elements 190 and 192. At a first temperature the bistable element 190 snaps to its high temperature state as shown in FIG. 7 whereupon the tip 210 engages the enlarged portion 214 on the upper surface of the slot 216 and moves the operator 216 upward pulling its end 230 out of engagement with the end 123 of the resilient switch arm 120 to allow the full resilient force of the arm 120 to snap the movable contact 122 into engagement with the stationary contact 124. This closes the switch 30*b* allowing electrical current to flow between the terminals 91 and 92. After a further duration and a further increase in the temperature of the bimetal elements 190 and 192 the bimetal element 192 snaps to its high temperature state, as shown in FIG. 8 causing the tip 208 to engage the upper surface of the slot 238 and move the operator 234 upward. In its upward movement, the end 252 of the operator 234 engages the free end 254 of the contact arm 144 disengaging the movable contact 146 from the stationary contact 150; and engaging the movable contact 148 with the stationary contact 152; this operates the single-pole double-throw switch 30*d* opening the circuit between the contact arm 144 and the normally closed contact 150 and closing circuit between the contact arm 144 and the normally open contact 152. Simultaneously the lower end 248 of the operator 234 moves upward allowing the free end 135 of the switch arm 132 and contact 134 to move upward engaging the movable contact 134 with the stationary contact 136 to close the switch 30*c***.

When the heat motor **30*a* is deenergized, the coil portions 180 and 182 cool allowing the bimetal elements 190 and 192 to cool. After a duration, the bimetal element 192 snaps from its high temperature state to its low temperature state, FIG. 7 opening the switch 30*c* and operating the switch 30*d* to engage contact 146 with contact 150 and to disengage contact 148 from contact 152. Upon further cooling, the bimetal element 190 snaps to its low temperature state opening the switch 30*b*, FIG. 3**.

The principle quantity of heat transferred from the portions 180 and 182 of the heat motor coil to the bimetal elements 190 and 192 is believed to be transferred by conduction through the U-shaped member 158 to the secured ends of the bimetal elements 190 and 192; the thin insulating layer 186, FIG. 1, has substantially less heat resistance than the space of air between the coil portions and the bimetal elements 190 and 192. Lesser quantities of heat are transferred by way of radiation and convection from the heating elements 180 and 182 to the bimetal elements 190 and 192. Having the heater coil split in two equal portions 180 and 182 promotes even heating of the bimetal elements 190 and 192. Having the portions 180 and 182 disposed directly beneath the bimetal elements 190 and 192 serves to partially surround the heating coil portions 180 and 182 on the upper side of the heating coil portions thus tending to prevent excessive loss of heat through radiation and convection currents. With the corners of the tips 208 and 210 of the bimetal elements 190 and 192 removed to form tapered ends, the bimetal elements 190 and 192 operate with less heat transfer from the supported ends to the tapered ends 208 and 210 due to the lesser degree of transverse curvature at the ends 208 and 210. Also the tapered ends 208 and 210 result in a more even operation of the bimetal elements 190 and 192 since the lesser degree of transverse curvature at the tips 208 and 210 allows operation at the lower temperature at the tips 208 and 210 due to the temperature gradient through the lengths of the bimetal elements 190 and 192.

The combination of the elongated snap acting bimetal element 190 supported at one point or end with the free end 210 engaging the operator 216 which is slidably mounted for operating the switch **30*b* results in a relatively low cost and reliable snap acting thermal relay. It is the particular structure of the bimetal element 190**, i.e., the cold formed transverse curvature opposing temperature warp and retaining the bimetal element against longitudinal curvature, that makes this combination possible.

The employment of the heater coil wound on the thermo-conducting support 158 makes possible the mounting of a plurality of snap acting bimetal elements on the support as well as providing a thermoconductive path for heat flow which can be easily made relatively uniform in relays manufactured in large quantities. Mounting the one end of the lower-temperature-operating bimetal element 190 overlapping the one end of the bimetal element 192 with the inside curvature of element 190 next to the outside curvature of element 192 allows both bimetal elements to be mounted at the same point on the support 158 without effecting the operation of either element; i.e, the bimetal element 190 first becomes flat in the transverse dimension not interfering with the element 192 later becoming transversely flat, and the element 192 first becomes transversely curved not interfering with the element 190 later becoming transversely curved. Switch operation of the sequencer 30 is enhanced by the free end 210 of the bimetal element 190 engaging the slide operator 216 in the slot 212. The lifting of the end 230 from the switch arm 120 and allowing the full resilient force of the arm 120 to engage the movable contact 122 with the stationary contact 124 produces improved electrical engagement between the contacts 122 and 124. Also, the use of the slot 238 in the operator 234 for receiving and engaging the free end 208 allows two switches to be operated by opposite ends of the operator 234.

Figure 9:
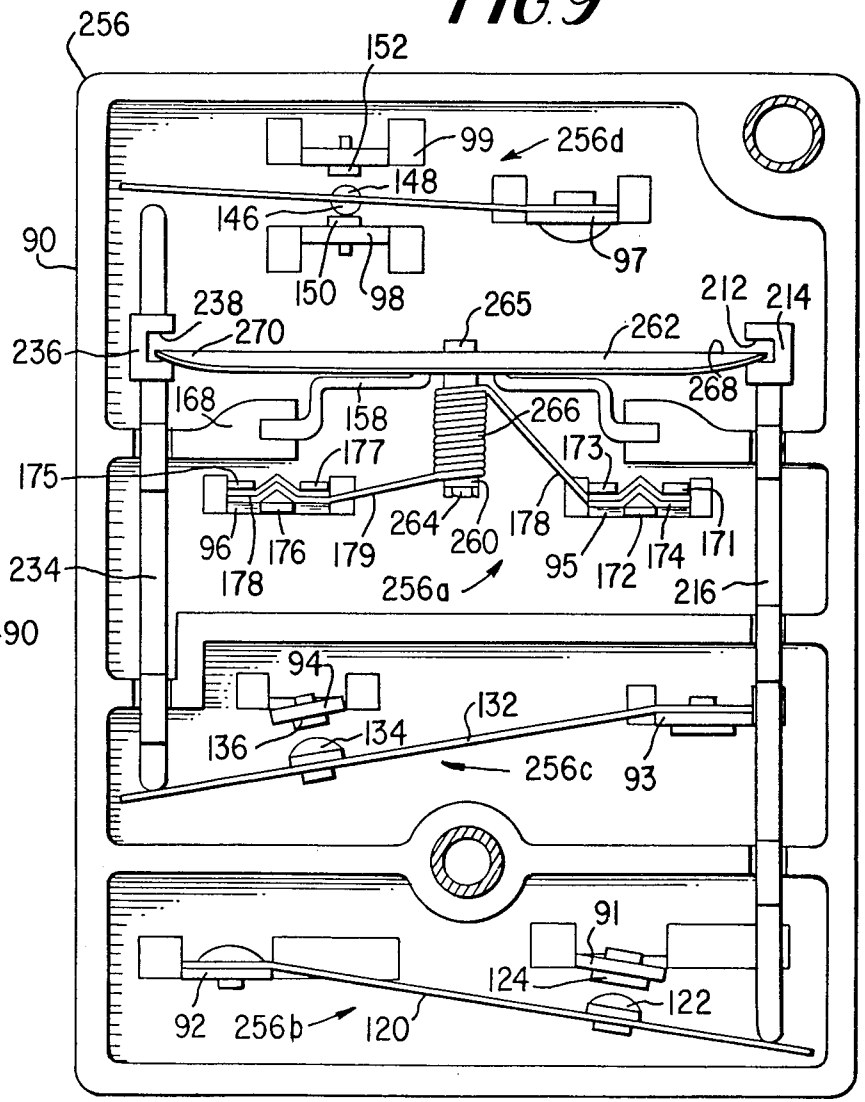
FIG. 9 is an elevation back view with a back cover removed of a modified sequencer.

In FIG. 9, there is shown a modified sequencer 256 with parts identified by the same numbers identifying parts in FIG. 3 illustrating that such parts have the same or similar structure and/or function. The modified sequencer 256 has a heat motor indicated generally at **256*a* which has a tubular conductive extension or post 260 and a bimetal element 262 attached by a bolt 264 and a nut 265 to the inverted U-shaped member 158. The post 260 is a section of thermoconductive tube, such as an aluminum tube which has an outer thin layer or film of electrical insulation similar to the layer 186, FIG. 4, upon which a coil 266 of insulated electrical resistance wire is wound. The ends 178 and 179 of the resistance wire are connected to the terminals 95 and 96 as previously described. The bimetal element 262 has its center point mounted on the member 158 and tapered free ends or tips 268 and 270 extending in opposite directions from the center point into the respective slots 212 and 238 or the operators 216 and 234. Similar to the bimetal elements 190 and 192 of the sequencer 30, the bimetal element 262** has a cold formed longitudinal curvature which is held straight by a cold formed transverse curvature opposite to the warp produced by increasing temperatures.

In operation of the modified sequencer 256, the free ends 268 and 270 will snap upward and downward substantially simultaneously to operate switches **256*b*, 256*c* and 246*d*** simultaneously.

One advantage of the structure of sequencers 30 and 256 is that the sequencers can be easily manufactured in many variations or modified forms. For example, in FIG. 10, there is shown a modified sequencer generally indicated at 272 in which the control or auxilliary switch is eliminated. In the modified sequencer 272, the terminals 97, 98 and 99, FIGS. 3 and 9, together with the contacts 146, 148, 150 and 152 and with arm 144 are left out in the manufacture of the sequencer 272 to eliminate unnecessary structure and reduce cost where such structure and its function are unnecessary. The slots 100 in the housing 90 for receiving the terminals can be left open, or closed with a break out web formed in molding the housing 90. It is also noted that the sequencer 272 uses the single bimetal element 262, FIG. 9.

Many other variations of the basic sequencer to FIG. 3 can be made including the elimination of one of the power switches, for example power switch **30*c* by leaving out the terminals 93 and 94 together with the contacts 134 and 136 and the contact arm 132 or the elimination of terminal 98 and contact 150, thus converting the switch 30*d*** into a normally open single-pole single-throw switch.

Figure 10:
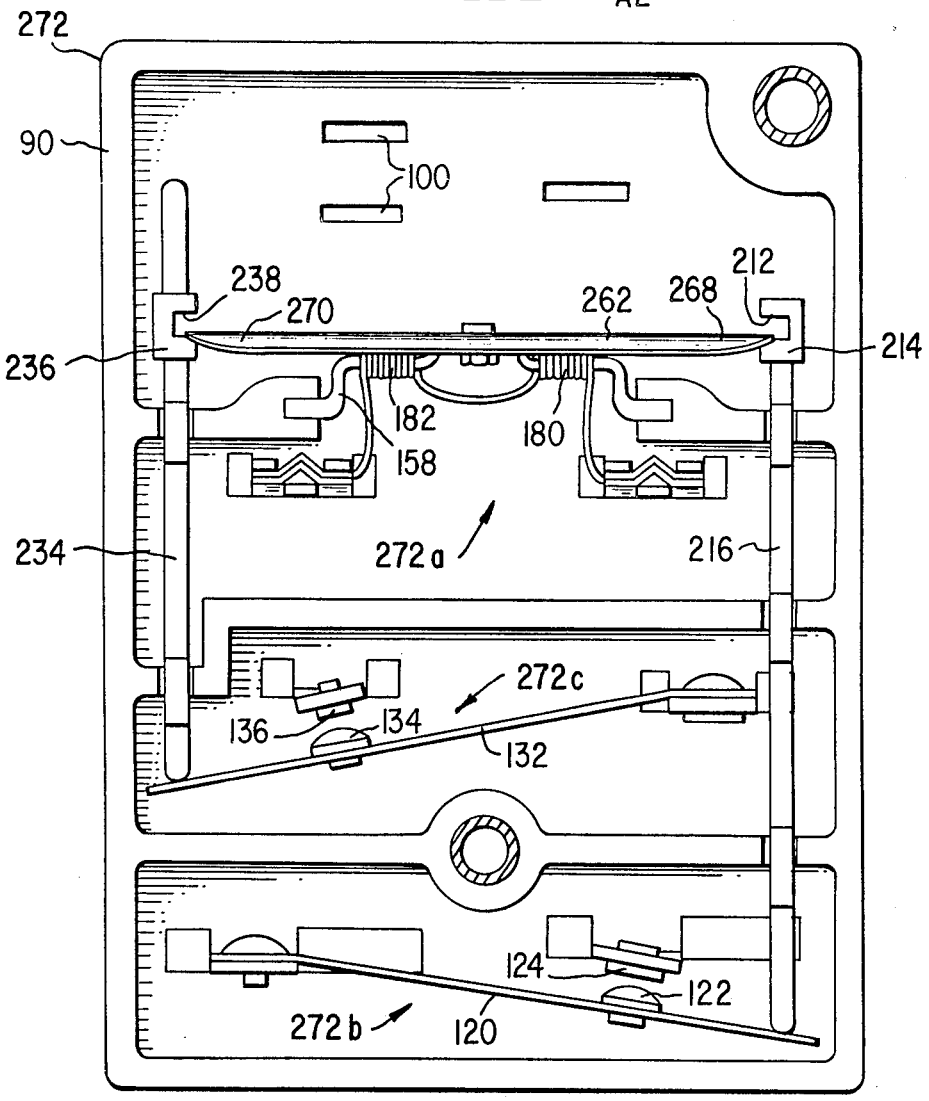
FIG. 10 is an elevation back view with the back cover removed of a further modification of the sequencer.

The circuit shown in FIG. 11 illustrates the use of a modified sequencer 276 which does not have a control switch similar to sequencer 272, FIG. 10, but includes two bimetal elements similar to sequencer 30, FIG. 3 for sequentially operating switches **276*b* and 276*c*. One side of the normally open switch 276*b* is connected to the power line 38 while the blower motor 28 and the heat resistance element 20 are connected between the other side of the switch 276*b* and the power line 40. Similarly, one side of the switch 276*c* is connected to the power line 38 while the heat resistance element 22 is connected between the power line 40 and the other side of the switch 276*c*. The contacts 34*a* of the thermostat 34 are connected between the terminals R and W of the low voltage terminal block 48 in series with the heat motor 276*a* across the secondary of the transformer 46**.

In operation of the modification shown in FIG. 11, the closing of the thermostat contacts **34*a* energizes the heat motor 276*a* which after a delay first closes switch 276*b* energizing the heating element 20 and the blower motor 28. After a further delay, the switch 276*c* closes energizing the heat resistance element 22. When the temperature sensed by the thermostat 34 rises to the selected temperature, the thermostat 34*a* opens deenergizing the heat element 276*a* which, after a first duration, opens the switch 276*c* deenergizing the element 22, and after a second duration, opens the switch 276*b* deenergizing the heating element 20 and the blower motor 28**.

FIG. 12 illustrates a circuit which employs the sequencers 256 and 272. The switches **256*b* and 272*b* are connected in parallel to each other and in series with the blower motor 28 across the power lines 38 and 40. One side of the switch 256*c* is connected to the power line 38 while the heater element 20 is connected between the power line 40 and the other side of the switch 256*c*. One side of the switch 272*c* is connected to the power line 38 while the heater element 22 is connected between the power line 40 and the other side of the switch 272*c*. The heat motor 256a is connected in series with the thermostat contacts 34a across the secondary of the transformer 46. The contact arm and the normally open contact of the switch 256d are connected in series with the heat motor 272a across the secondary of the transformer 46**.

In operation of the circuit variation of FIG. 12, the blower motor 28 and the heating elements 20 and 22 are energized by separate switches 256b, 256c and 272d. Switches 256b, 256c and 256d are operated simultaneously while switches 272c and 272b are operated after a delay from the closing of switch 256d. After opening of thermostat contacts 34a, the switches 256b, 256c and 256d are opened after a first delay and then switches 272b and 272c are opened after a further delay. With the switches 256b and 272b connected in parallel, the motor 28 remains operating when any of the elements 20 and 22 are energized.

Figure 13:
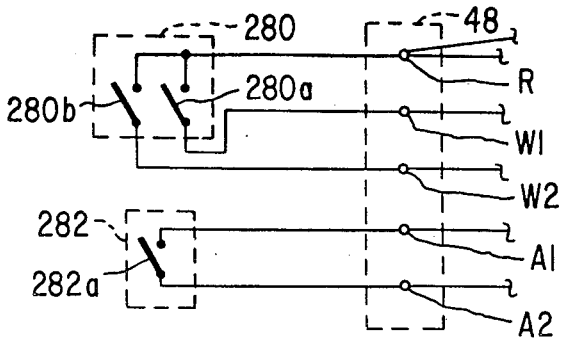
FIG. 13 is a diagram of a modification which can be made to the heating system circuit shown in FIG. 1.

The heating system circuit of FIG. 1 can be adapted for two stage operation and/or outdoor thermostat control as shown in FIG. 13 wherein a two stage thermostat device 280 and an outdoor thermostat 282 are added. First stage contacts 280a of the thermostat 280 are connected across the terminals R and W2, and contacts 282a of the thermostat 282 are connected across terminals A1 and A2. First stage contacts 280a close at temperatures below a first selected temperature while second stage contacts 280b close at temperatures below a second selected temperature which is less than the first temperature. Thus, the sequencer 32, FIG. 1 as modified by FIG. 13, will not operate unless both the inside and outside temperatures are below selected temperatures indicating a need by greater heat production.

A three element heating system can be made by using a wiring configuration similar to FIG. 12; but using sequencers with sequential operating switches 256b, 256c, 272b and 272c rather than simultaneous, and further connecting an additional element in parallel to the blower motor 28.

Since many modifications, variations, or changes in detail can be made to the present embodiment, it is intended that all matter in the foregoing description or shown in the accompanying drawings be interpreted as illustrative and not in a limiting sense.

What is claimed is:

1. An elongated snap-acting bimetal element having a single stable state at a predetermined temperature comprising a first strip-like layer of metal having a first coefficient of thermal expansion, a second strip-like layer of metal bonded on the first layer and having a second coefficient of thermal expansion, said second coefficient of thermal expansion being substantially different from the first coefficient of thermal expansion, said first and second bonded layers adapted to be secured at one end with the other end extending free, said first and second bonded layers being bent into a transverse radius of curvature of about the predetermined temperature to retain the bonded first and second layers against longitudinal curvature until a temperature is reached whereat longitudinal curvature forces exceed the retaining forces of the transverse curvature producing snap longitudinal curvature changes, said first and second bonded layer also being stressed toward a longitudinal radius of curvature at about the predetermined temperature, said transverse radius of curvature being selected to oppose the force of temperature warp by increasing temperature, and said longitudinal radius of curvature being greater than the transverse radius of curvature and being selected to add to the force of temperature warp by increasing temperature.

2. An elongated snap-acting bimetal element as claimed in claim 1 wherein the grain directions of the first and second bonded layers generally run along the longitudinal directions of the bonded layers.

3. An elongated snap-acting bimetal element as claimed in claim 1 wherein said other end of the first and second bonded strip-like layers is formed with a transverse tapered dimension.

* * * * *